US007363916B2

(12) United States Patent
Eser et al.

(10) Patent No.: US 7,363,916 B2
(45) Date of Patent: Apr. 29, 2008

(54) FUEL INJECTION SYSTEM AND METHOD FOR DETERMINING THE FEED PRESSURE OF A FUEL PUMP

(75) Inventors: Gerhard Eser, Hemau (DE); Gerhard Schopp, Pettendorf (DE)

(73) Assignee: Siemens Aktiengesellschaft, Munich (DE)

( * ) Notice: Subject to any disclaimer, the term of this patent is extended or adjusted under 35 U.S.C. 154(b) by 66 days.

(21) Appl. No.: 10/542,118

(22) PCT Filed: Oct. 28, 2003

(86) PCT No.: PCT/DE03/03579

§ 371 (c)(1),
(2), (4) Date: Apr. 18, 2006

(87) PCT Pub. No.: WO2004/067948

PCT Pub. Date: Aug. 12, 2004

(65) Prior Publication Data

US 2006/0225706 A1 Oct. 12, 2006

(30) Foreign Application Priority Data

Jan. 13, 2003 (DE) ..... 103 00 929

(51) Int. Cl.
*F02M 37/04* (2006.01)
*F02D 41/00* (2006.01)

(52) U.S. Cl. ..... 123/497; 123/516; 123/689

(58) Field of Classification Search ..... 123/497, 123/516, 686, 689
See application file for complete search history.

(56) References Cited

U.S. PATENT DOCUMENTS

| | | | | |
|---|---|---|---|---|
| 5,044,344 | A * | 9/1991 | Tuckey et al. | 123/497 |
| 5,237,975 | A * | 8/1993 | Betki et al. | 123/497 |
| 5,651,347 | A * | 7/1997 | Oi et al. | 123/487 |
| 6,367,455 | B2 * | 4/2002 | Hirata et al. | 123/497 |
| 2001/0023683 | A1 * | 9/2001 | Nakamura et al. | 123/457 |
| 2002/0020397 | A1 * | 2/2002 | Begley et al. | 123/497 |
| 2002/0043253 | A1 * | 4/2002 | Begley et al. | 123/497 |

FOREIGN PATENT DOCUMENTS

| | | |
|---|---|---|
| DE | 43 34 923 C2 | 4/1994 |
| DE | 44 29 271 C2 | 2/1995 |
| DE | 199 51 410 A1 | 5/2001 |
| DE | 100 59 570 A1 | 7/2001 |
| DE | 101 37 315 A1 | 2/2003 |
| DE | 101 52 236 A1 | 4/2003 |
| EP | 1 223 326 A2 | 7/2002 |

* cited by examiner

*Primary Examiner*—Thomas Moulis

(57) ABSTRACT

The invention relates to a fuel injection system comprising a fuel reservoir to which fuel is fed via at least one first pump and from which fuel is discharged via injectors. The invention is characterized in that the feed pressure of the first pump is adjusted depending on fuel temperature and evaporative behavior of the fuel.

14 Claims, 3 Drawing Sheets

FUEL INJECTION SYSTEM AND METHOD FOR DETERMINING THE FEED PRESSURE OF A FUEL PUMP

CROSS REFERENCE TO RELATED APPLICATIONS

This application claims priority to the German application No. 10300929.9, filed Jan. 13, 2003 and to the International Application No. PCT/DE2003/003579, filed Oct. 28, 2003 which are incorporated by reference herein in their entirety.

FIELD & BACKGROUND OF INVENTION

The invention relates to a fuel injection system with a fuel reservoir to which fuel is fed via at least one first pump and from which fuel is discharged via injectors.

The invention further relates to a method for determining the feed pressure of a first pump of a fuel injection system which features a fuel reservoir, to which fuel is fed via at least a first pump and from which fuel is discharged via injectors.

SUMMARY OF INVENTION

In the generic fuel injection system for internal combustion engines the fuel is fed with at least one pump from the tank into a fuel reservoir, a process also referred to as the fuel trail. Via injectors connected to the fuel reservoir the fuel mass is brought from the fuel reservoir into the combustion chamber or into at least one vacuum pipe of the internal combustion engine. To enable the fuel mass fed in to be injected, the injectors are opened for a defined period. The feed pressure of the pump must be high enough to enable a cavitation through vaporization of fuel in the system to be avoided, with the pressure at which the fuel vaporizes essentially depending on the fuel temperature and the vaporization behavior of the fuel. Even if the fuel temperature is employed for determining the required value for the feed pressure it is still necessary, to ensure that a cavitation is avoided, to provide an appropriate reserve in the fuel pressure for fuel with a high tendency to vaporization, for example for winter fuels or what are known as "worst-case fuels".

An object of the invention is to develop a fuel injection system and a method such that the energy consumption for driving the pump and thereby the fuel consumption is reduced while still avoiding a cavitation through vaporization of fuel.

This object is achieved by the claims.

Advantageous embodiments and developments of the invention are produced by the dependent claims.

The fuel injection system in accordance with the invention builds on the generic prior art by adjusting the feed pressure of the first pump as a function of the fuel temperature and the vaporization behavior of the fuel. Since with this solution the current fuel characteristics are included in the feed pressure or in the calculation of the required value for the feed pressure respectively, it is no longer necessary to provide a corresponding reserve in the fuel pressure for fuel with a greater tendency to vaporize, for example the winter fuels or the worst-case fuels mentioned above, so that the energy consumption of the pump and thereby the fuel consumption can be reduced overall.

With preferred embodiments of the fuel injection system in accordance with the invention there is further provision for the feed pressure of the first pump to be set to a minimum value, in which a cavitation through vaporization of fuel is avoided. This reduces the energy consumption of the pump as much as possible.

In preferred further developments of the fuel injection system in accordance with the invention there is provision for the feed pressure of the first pump to be set by a control and/or regulation device which activates the first pump. In the case of a regulation device a fuel pressure sensor is preferably provided behind the pump, said sensor supplying an actual fuel pressure value or a corresponding signal which is fed to the control and/or regulation device. The latter calculates a required fuel pressure value as a function of the fuel temperature and the vaporization behavior of the fuel. In this case the fuel temperature can for example be determined using a fuel temperature model and the vaporization behavior of the fuel can be determined by adapting the starting volume, a concept will be explained later in this document. Based on a comparison of the actual fuel pressure value and the required fuel pressure value, a suitable pump control process can then be calculated.

As already explained, there can be provision with specific embodiments of the fuel injection system in accordance with the invention for the control and/or regulation device to determine the fuel temperature by modelling. For example sensors which are used in any event to record the temperatures, for example the coolant temperature and so forth, can determine the fuel temperature at a particular time.

Alternatively embodiments of the fuel injection system in accordance with the invention are considered in which there is provision for the fuel temperature recorded by a temperature sensor to be fed to the control and/or regulation device. In this case it is advantageous for the temperature sensor to record the fuel temperature behind the pump.

Furthermore embodiments of the fuel injection system in accordance with the invention are considered in which there is provision for the control and/or regulation device to determine the vaporization behavior of the fuel through modelling. Modelling is preferred in this context because a direct determination of the vaporization behavior of the fuel in the motor vehicle is comparatively complex. The basic idea of the invention however includes a number of options for informing the control and/or regulation device about the vaporization behavior of the fuel in the tank.

Especially if the vaporization behavior of the fuel is determined by modelling, embodiments of the fuel injection system in accordance with the invention are considered in which there is provision for the vaporization behavior of the fuel to be determined using a fuel volume adaptation algorithm. The fuel volume adaptation algorithm is provided in any event with many generic fuel injection systems to set the volume of the fuel injected. Since the volume of the fuel to be injected also depends on the vaporization behavior of the fuel, direct or indirect conclusions can be drawn in a particularly simple way about the vaporization behavior of the fuel from the fuel volume adaptation algorithm.

In addition or as an alternative there can be provision in the fuel injection system in accordance with the invention for a Lambda probe output signal to be employed to determine the vaporization behavior of the fuel. If the same volume of fuel with different vaporization behavior is injected, different Lambda probe signals are obtained. It is thus possible for example to provide performance data in which a conclusion can be drawn from the Lambda probe output signal about the vaporization behavior of the fuel.

With an especially preferred embodiment of the fuel injection system in accordance with the invention there is provision for the first pump to be a low-pressure pump and for a second pump in the form of a high-pressure pump to be connected downstream from the low-pressure pump. The high-pressure pump can especially be a high-pressure pump with a controlled or regulated mass flow.

The method in accordance with the invention builds on the generic prior art in that the feed pressure of the first pump is set as a function of the fuel temperature and the vaporization behavior of the fuel. Through this solution the advantages of the fuel injection system in accordance with the invention are achieved in the same or in a similar way, with reference being made to the corresponding embodiments for execution of repetitions.

The same then applies analogously to the advantageous embodiments and further developments of the method in accordance with the invention specified below, with reference being made regarding these to the corresponding embodiments in connection with the fuel injection system in accordance with the invention.

With preferred embodiments of the method in accordance with the invention there is provision for the feed pressure of the first pump to be set to a minimum value at which a cavitation through vaporization of fuel is just avoided.

Also with the inventive method there can be provision for the feed pressure of the first pump to be set by a control and/or regulation device which controls the first pump.

Furthermore specific embodiments of the method in accordance with the invention can provide for the fuel temperature to be determined by modelling.

Alternatively there can be provision with the method in accordance with the invention for the fuel temperature to be recorded via a temperature sensor.

It is also preferred with the method in accordance with the invention for the vaporization behavior of the fuel to be determined by modelling.

In this case there can especially be provision for the vaporization behavior of the fuel to be determined using a fuel volume adaptation algorithm.

A preferred further development of the method in accordance with the invention makes provision for a Lambda probe signal to be employed for determining the vaporization behavior of the fuel.

It is also considered especially advantageous in connection with the inventive method for the first pump to be a low-pressure pump and for a second pump in the form of a high-pressure pump to be connected downstream from the low-pressure pump.

The invention especially makes it possible to determine the necessary required value for the feed pressure of a low-pressure fuel pump such that a cavitation is(just) avoided. This can advantageously be done by modelling the fuel temperature on the basis of measured values or model values already present in the control and/or regulation device as well as by calculating in the adaptation values, especially of the fuel start volume adaptation. The start volume adaptation is a functionality which adapts the volume of fuel injected at the start as a function of the vaporization behavior of the fuel. For example by reducing the required fuel pressure value in runup of a high-pressure pump to a minimum value fuel saving can be achieved as a result of the reduced feed power of the low-pressure fuel pump.

BRIEF DESCRIPTION OF THE DRAWINGS

The invention is now explained by an example which refers to the enclosed drawings on the basis of a preferred embodiment.

The figures show.

DETAILED DESCRIPTION OF INVENTION

Figure 1:
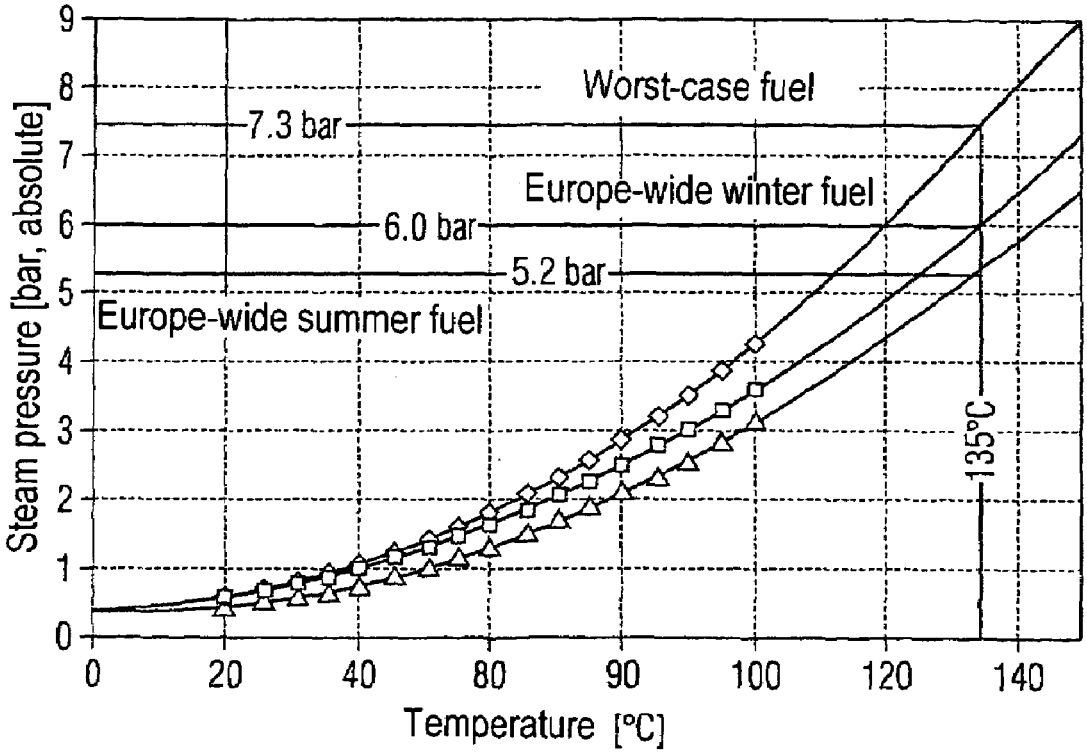
FIG. 1 typical steam pressure curves for commercially-available fuel.

FIG. 1 illustrates typical steam pressure curves of commercially-available fuel. The diagram show, from top to bottom, the curves for what is referred to as a worst-case-fuel, a Europe-wide winter fuel and a Europe-wide summer fuel. It can be seen from the diagram in FIG. 1 that with worst-case fuel a higher pressure is required than with Europe-wide summer fuels in order to avoid a cavitation through vaporization of fuel.

Figure 2:
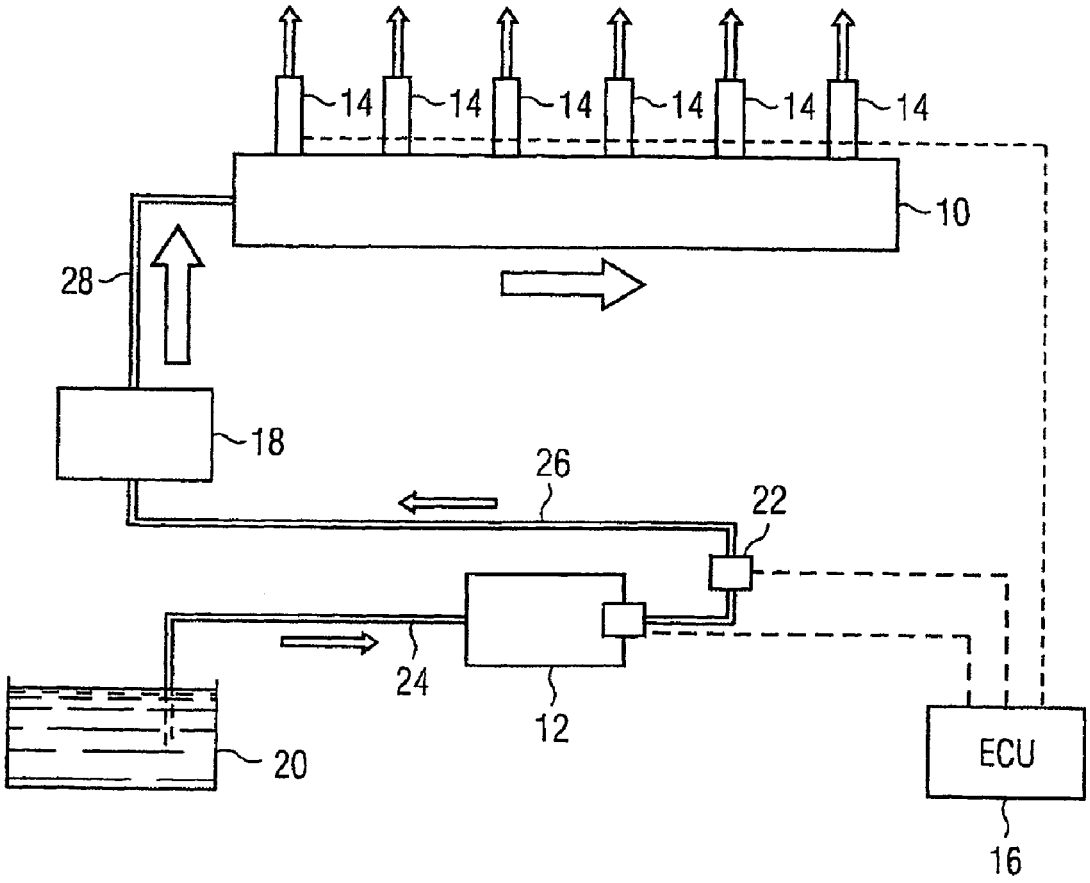
FIG. 2 a schematic diagram of an embodiment of the fuel injection system in accordance with the invention.

FIG. 2 shows a schematic diagram of an embodiment of the fuel injection system in accordance with the invention. These types of injection system are also known as common rail injection systems. The fuel injection system shown features a rail or a fuel reservoir 10 to which a number of injectors 14 are assigned, via which the fuel can be injected from the fuel reservoir 10 into the combustion chambers or a vacuum pipe of an internal combustion engine. The injectors 14 are controlled by a control and/or regulation device 16 in order to open for a period determined by the control and/or regulation device 16. The fuel reservoir 10 is connected via a high-pressure line 28 with the output of a mass flow-regulated high-pressure pump 18. The suction side of the high-pressure pump 18 is connected via a low-pressure line to the outlet 26 of a low-pressure pump 12. The suction side of the low-pressure pump 12 is connected via a suction line 24 with a fuel tank 20 from which fuel can be drawn. The feed pressure of the low-pressure pump 12 is set by a control and/or regulation device 16. Furthermore the output signal of a pressure sensor 22 arranged in the low-pressure line 26 is fed to the control and/or regulation device 16.

The control and/or regulation device 16 has available to it models for determining the fuel temperature and the vaporization behavior of the fuel present at the time in the fuel tank 20. These models can evaluate the output signal of sensors which are not shown but are still present however. Especially as regards the fuel temperature, it would alternatively be possible in a relatively simple way to provide a temperature sensor in or on the low pressure line 26. The control and/or regulation device 16 calculates a required feed pressure value on the basis of the fuel temperature and the vaporization behavior of the fuel and compares this value with an actual value determined via the pressure sensor 22, to suitably adjust the feed pressure of the low-pressure pump 12 to the required feed pressure value. Where the fuel tank 20 contains fuel with a higher tendency to vaporization a higher value is produced for the required feed pressure value than in a case in which a fuel with lower tendency to vaporization is contained in the fuel tank 20. In this way the required feed pressure value can be kept to a minimum value at which a cavitation through vaporization of fuel is just avoided. Compared to known solutions the energy required to drive the low-pressure pump 12 is reduced, which leads to savings in fuel.

Figure 3:
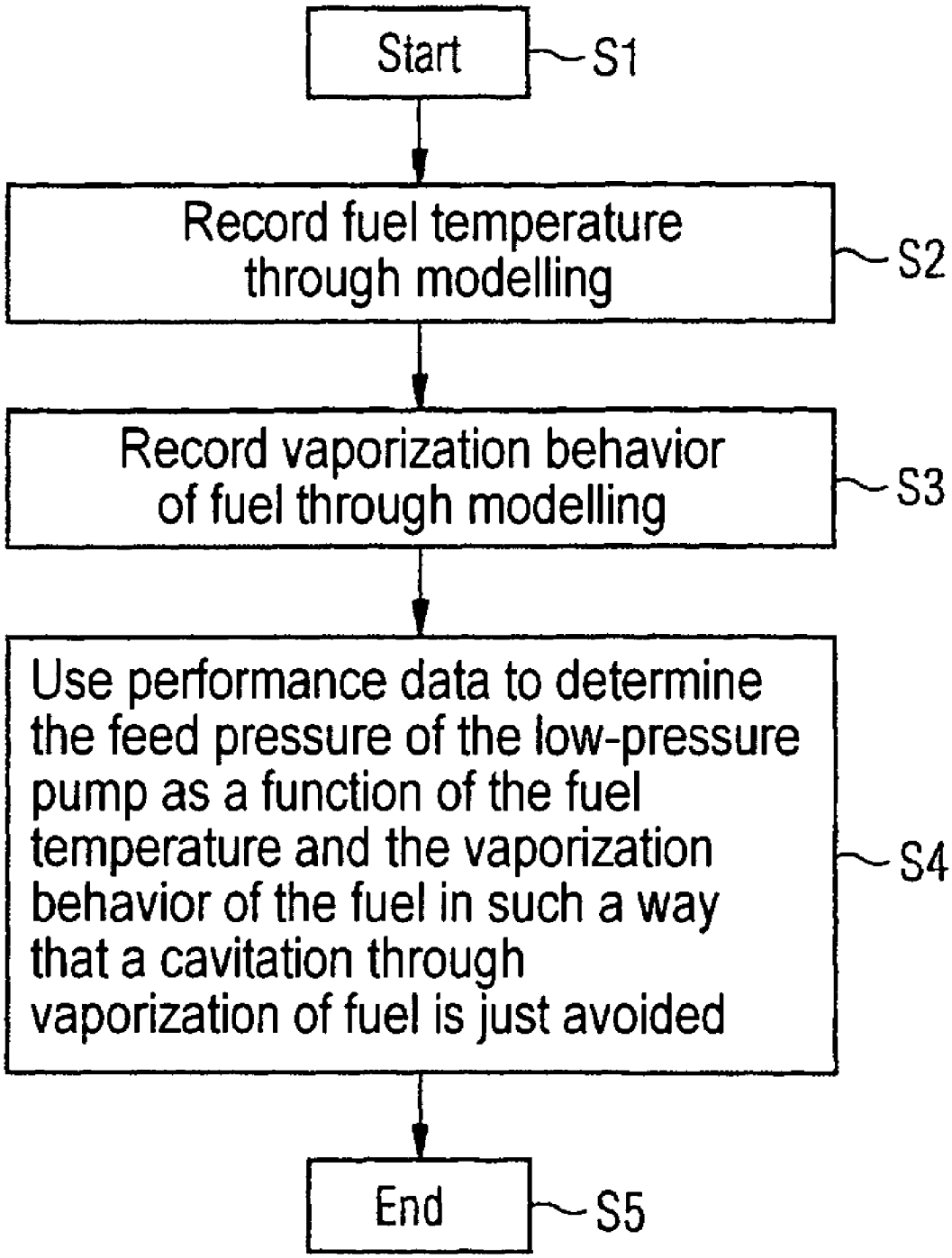
FIG. 3 a flowchart which illustrates an embodiment of the method in accordance with the invention.

FIG. 3 shows a flowchart which illustrates an embodiment of the method in accordance with the invention. The method shown begins at step S1. In step S2 the fuel temperature is recorded by modelling. To this end the current fuel temperature can be deduced in an especially advantageous way from the coolant temperature which is known in any event. In step S3 the vaporization behavior of the fuel is recorded by modelling. The Lambda probe output signal can be employed for this purpose for example since different Lambda probe output signals are received if the same volumes of fuel are injected with different vaporization behavior. In step S4 the feed pressure of the low-pressure pump is determined by performance data as a function of the fuel temperature and the vaporization behavior of the fuel, for example via performance data as shown in FIG. 1. The feed pressure of the low-pressure pump in this case is preferably defined such that a cavitation through vaporization of fuel is just avoided. The embodiment of the method in accordance with the invention shown ends with step 5.

The features of the invention disclosed in this description, in the drawings and in the claims, can be of importance both individually and in any combination for implementing the invention.

The invention claimed is:

1. A fuel injection system, comprising:

a fuel reservoir;

a first pump connected to the fuel reservoir for feeding a fuel to the fuel reservoir;

a plurality of injectors connected to the fuel reservoir for discharging the fuel from the fuel reservoir; and a control and regulation device connected to the first pump for controlling the first pump, the control and regulation device configured to adjust a feed pressure of the first pump based on a fuel temperature and a vaporization characteristic of the fuel, wherein the vaporization characteristic of the fuel is determined by the control and regulation device using an output signal of a Lambda probe.

2. The fuel injection system in accordance with claim 1, wherein the vaporization characteristic of the fuel is determined by the control and regulation device based on a mathematical vaporization model.

3. The fuel injection system in accordance with claim 1, wherein the feed pressure is adjusted to an as low as possible minimum pressure value such that cavitation caused by vaporization of the fuel is avoided.

4. The fuel injection system in accordance with claim 1, wherein the fuel temperature is determined by the control and regulation device based on a mathematical temperature model.

5. The fuel injection system in accordance with claim 1, wherein the fuel temperature is acquired by a temperature sensor and fed to the control and regulation device.

6. The fuel injection system in accordance with claim 1, wherein the vaporization characteristic of the fuel is determined using a fuel volume adaptation algorithm.

7. The Fuel injection system in accordance with claim 1, further comprising a second pump connected to and arranged downstream of the first pump relative to a fuel pumping direction, wherein the first pump is a low-pressure pump.

8. A method of determining a feed pressure of a first pump of a fuel injection system, the fuel injection system having a fuel reservoir to which fuel is fed via the first pump and from which fuel is discharged via a plurality of injectors, comprising adjusting the feed pressure by a control and regulation device based on a fuel temperature and a vaporization characteristic of the fuel, wherein the vaporization characteristic of the fuel is determined by the control and regulation device using an output signal of a Lambda probe.

9. The method according to claim 8, wherein the vaporization characteristic of the fuel is determined by the control and regulation device based on a mathematical vaporization model.

10. The method according to claim 8, wherein the feed pressure is adjusted to an as low as possible minimum pressure value such that cavitation caused by vaporization of the fuel is avoided.

11. The method according to claim 8, wherein the fuel temperature is determined by the control and regulation device based on a mathematical temperature model.

12. The method according to claim 8, wherein the fuel temperature is acquired by a temperature sensor.

13. The method according to claim 8, wherein the vaporization characteristic of the fuel is determined using a fuel volume adaptation algorithm.

14. The method according to claim 8, wherein the first pump is a low-pressure pump, and a second pump embodied as a high-pressure pump is connected to and arranged downstream from the low-pressure pump relative to a fuel pumping direction.

* * * * *